United States Patent [19]

Takada

[11] 4,020,641

[45] May 3, 1977

[54] METHOD OF LAYING PIPES IN THE GROUND

[75] Inventor: Hiroshi Takada, Yokohama, Japan

[73] Assignee: Kabushiki Kaisha Komatsu Seisakusho, Tokyo, Japan

[22] Filed: Dec. 22, 1975

[21] Appl. No.: 643,115

[52] U.S. Cl. ..... 61/72.7; 61/42; 175/62; 254/29 R

[51] Int. Cl.[2] ..... F16L 1/00

[58] Field of Search ..... 61/72.7, 72.5, 72.1, 61/42, 41 A; 254/29; 175/62

[56] References Cited

UNITED STATES PATENTS

| | | | |
|---|---|---|---|
| 2,656,683 | 10/1953 | Riva | 61/72.7 |
| 3,713,500 | 1/1973 | Russell | 175/73 |
| 3,742,581 | 7/1973 | Roodveis | 61/72.7 X |
| 3,881,558 | 5/1975 | Dolza | 61/72.7 |
| 3,894,402 | 7/1975 | Cherrington | 175/62 X |

*Primary Examiner*—Jacob Shapiro
*Attorney, Agent, or Firm*—Armstrong, Nikaido & Marmelstein

[57] ABSTRACT

There is disclosed a method of laying small-diameter pipes such as gas, water pipes or the like precisely in position in the ground. Small-diameter pilot pipes are first laid in with a pilot head being measured and controlled in order to make its advance straight. Pipes which are larger in diameter than the pilot pipes are then laid in successively, the large-diameter pipes being led by the pilot pipes. A multistage head is used as a head utilized for consolidation of soil and disposed in a following relationship to the pilot pipes, thereby reducing resistance exerted upon the head.

4 Claims, 14 Drawing Figures

METHOD OF LAYING PIPES IN THE GROUND

BACKGROUND OF THE INVENTION

This invention relates to a method and apparatus for laying pipes in the ground and, more particularly, to the laying-in of pipes such as drainage, gas, water pipes, or cables of a relatively small diameter.

One of the more common ways of laying pipes into the ground is that trenches are dug, the pipes are then placed in the trench, and finally the trench is filled with earth. When a relatively large land space is available, no difficulty with this method of laying-in of the pipes exists. However, various problems arise when digging trenches in roads is carried out in big cities where sufficient land spaces are not available. More specifically, for instance, pavement must be destroyed and the trafic is obstructed in the course of construction.

Various attempts have heretofore been made to eliminate these problems by laying the pipes in the ground without digging the trenches. One such attempt has been to lay in the pipes when the excavated earth is discharged from the rear end of the laid-in pipes and another attempt has been to press the pipes into the ground upon consolidation of soil. A major difficulty with the first-mentioned attempt is that the scraped soil is removed from the rear end of the pipes by means for example of screw conveyors disposed within the pipes and, hence, the pipes are filled up with the scraped soil which is being discharged, with the results that the foremost point where the excavation is carried out can not be detected from a departure pit from which the pipes are laid in, and thus the straight advance of the laid-in pipes is difficult to maintain. Furthermore, since the scraped soil is discharged into the departure pit, installation of a jack for pressing the pipes to be laid in, and control equipment and the like within the departure pit is limited, and the earth hauling operation is interfered, thereby, resulting in poor working efficiency. Later attempts to provide a detector pipe extending along the peripheral surface of and in parallel with the axis of the laid-in pipes so as to detect a vertical position of the front end of the laid-in pipes from the departure pit, have met with only partial success, since these attempts have involved undesirable additional procedures to remove the detector pipe and to fill the space formed therby with cement or the like, after the laying-in of the pipes is completed. Other difficulties occurring with the first-mentioned attempt are as follows: it is difficult to control the direction of advance of the laid-in pipes since the posture of the foremost, excavating point is unable to be detected and, hence, the operator must be skilled in ensuring that the pipes are advanced as straight as possible; (1) the screw conveyor rotated in the laid-in pipes tends to damage the inner surface of the pipes; (2) for this reason, the pipes to be laid in are in most cases limited to steel pipes since pipes of reinforced concrete are not suitable for this method; (3) where it is absolutely necessary to use the pipes of reinforced concrete, steel pipes should be placed in the reinforced concrete pipes in order to prevent the inner surface of the latter from being damaged by the rotating screw conveyor; and (4) there must be inserted the screw conveyor that fits with the internal diameter of the pipes, and this increases the cost of equipment because construction must have a wide variation in types and forms of screw conveyors to accommodate many different sizes of pipes to be laid in.

A difficulty attendant with the other attempt to press the pipes into the ground upon consolidation of soil is that since the degree of consolidation of soil is increased as the laid-in pipes increase in diameter, a large apparatus is necessary in order to obtain a jack pressure large enough to press pipes of corresponding sizes into the ground.

According to another method disclosed in Japanese Patent Publication No. 49-19767, small-diameter pilot pipes are first pressed into the ground by a hydrulic jack, and large-diameter pipes are led by the pilot pipes then laid in the ground. While this method is highly efficient, straight advancement of the laid-in pipes is not obtained because of the lack of control of the front end of the pilot head. The pilot pipes are followed by the large-diameter pipes which are laid-in upon consolidation of soil without excavating earth, and thus a relatively large consolidation pressure becomes necessary. This requires a large-sized apparatus. In short, this latter method shares the common deficiencies with the foregoing prior art attempt which makes use of consolidation of soil. While this method is highly efficient, it is not satisfactory to lay the pilot pipes precisely in position since the front end of the pilot pipes are uncontrolled. Furthermore, when large-diameter pipes are led by the laid-in pilot pipes and laid in the ground, a single conical head is employed for consolidation of soil in order to lay in the pipes. Therefore, there are required a large propulsion force and thus a large-sized apparatus.

SUMMARY OF THE INVENTION

In accordance with the invention, there is provided, in laying in pilot pipes by a propulsion jack, a method of laying in a pilot head with its position and posture being measured and controlled, and thereafter laying in pipes which are larger in diameter than the pilot pipes which are led by the laid-in pilot pipes. A head following the pilot pipes is of the multistage type in order to reduce resistance created during consolidation of soil. Where soil is compressed at one time by the full cross-section of the laid-in pipes, an extremely large propulsion force becomes necessary. This causes the laid-in pipes to be subject to a large thrust load and, in addition, requires a large capacity propulsion jack. By using a multistage head for pipes to be laid in, relatively large-diameter pipes can be laid in without recourse to a large propulsion force.

It is therefore an object of the present invention to provide a method of laying pipes in the ground which method will overcome the above-noted difficulties.

Another object of the invention is to provide a method of laying pipes precisely in a desired position.

A still another object of the invention is to provide a method capable of laying in pipes with a relatively small propulsion force.

Other objects, features and advantages of the present invention will be readily apparent from the follwing description taken in conjunction with the accompanying drawings.

BRIEF DESCRIPTION OF THE DRAWINGS

FIGS. 6-1 through 6-4 are enlarged views illustrating successive steps of operation relative to the direction correction of the pilot head;

FIGS. 9-1 through 9-3 are longitudinal cross-sectional views showing successive operational steps of the multistage head.

DETAILED DESCRIPTION OF THE PREFERRED EMBODIMENT

Figure 1:
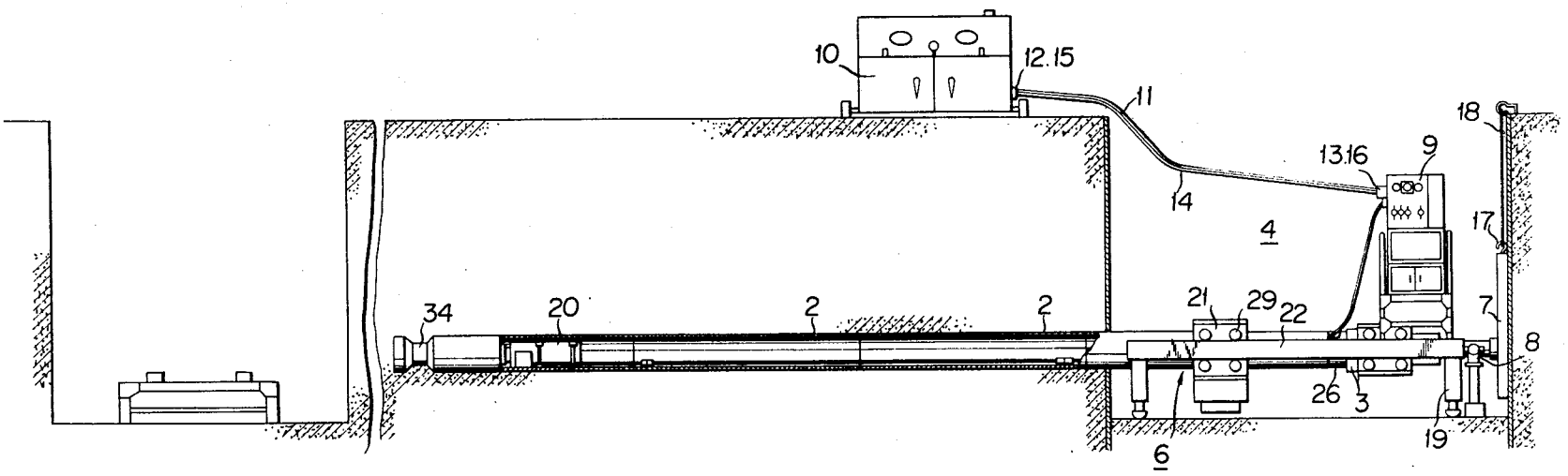
FIG. 1 is a schematic elevational view explanatory of the way in which pilot pipes are laid into the ground in accordance with a method of the invention.

In FIG. 1, there is shown a pilot head 1 and pilot pipes 2 connected in following relation to the pilot head 1, the pilot head 1 and the pilot pipes 2 pressed into the ground by a propulsion jack 3. The pilot pipes 2 are propelled from a departure pit 4 until a leading pipe 2 reaches an arrival pit 5.

The departure pit 4 has therein a propulsion device 6, a reaction plate 7, a transit 8 and a control unit 9. The control unit 9 is operated by the operator to control the overall operation.

On the ground surface above the departure pit 4, there is provided a power source 10 form which an oil pressure is supplied through a hydraulic rubber hose 11 to the control unit 9. The hydraulic rubber hose 11 has at both ends a pair of connectors 12, 13 to facilitate connection with the power source 10 and the control unit 9. Electric power is supplied through the power source 10 and an electric cable 14 to the control unit 9. The electric cable 14 has at the both ends a pair of connectors 15, 16 to facilitate connection with the power source 10 and the control unit 9.

Where the length of one hydraulic rubber hose 11 or one electric cable 14 is short of the depth of the departure pit 4, additional hoses or cables of the same size can be used so as to increase the overall length of the combined hoses or cables.

The reaction plate 7 has at its top a hanging hook 17 to which there is connected a wire 18 extending from the top of a sheathing board, thereby hanging the reaction plate 7.

Four legs 19 are provided beneath the propulsion divice 6, the legs 19 being vertically extensible by hydraulic pressure so that the propulsion device 6 can be maintained at a given height and grade. The hydraulic pressure is of course supplied from the control unit 9.

A transit 8 (this may be a laser transit or a laser beam emitter ) is provided on the bottom of the departure pit 4 and is positioned slightly forwardly of the reaction plate 7, the transit 8 being so arranged at a given position and grade as to be able to measure a target 20 located at the rear end of the pilot head 1. A pipe support 21 has pipe supporting rollers the height of which is adjustable by a jack in order to maintain a pipe at a given elevation when the pipe is placed on the supporting rollers.

Figure 2:
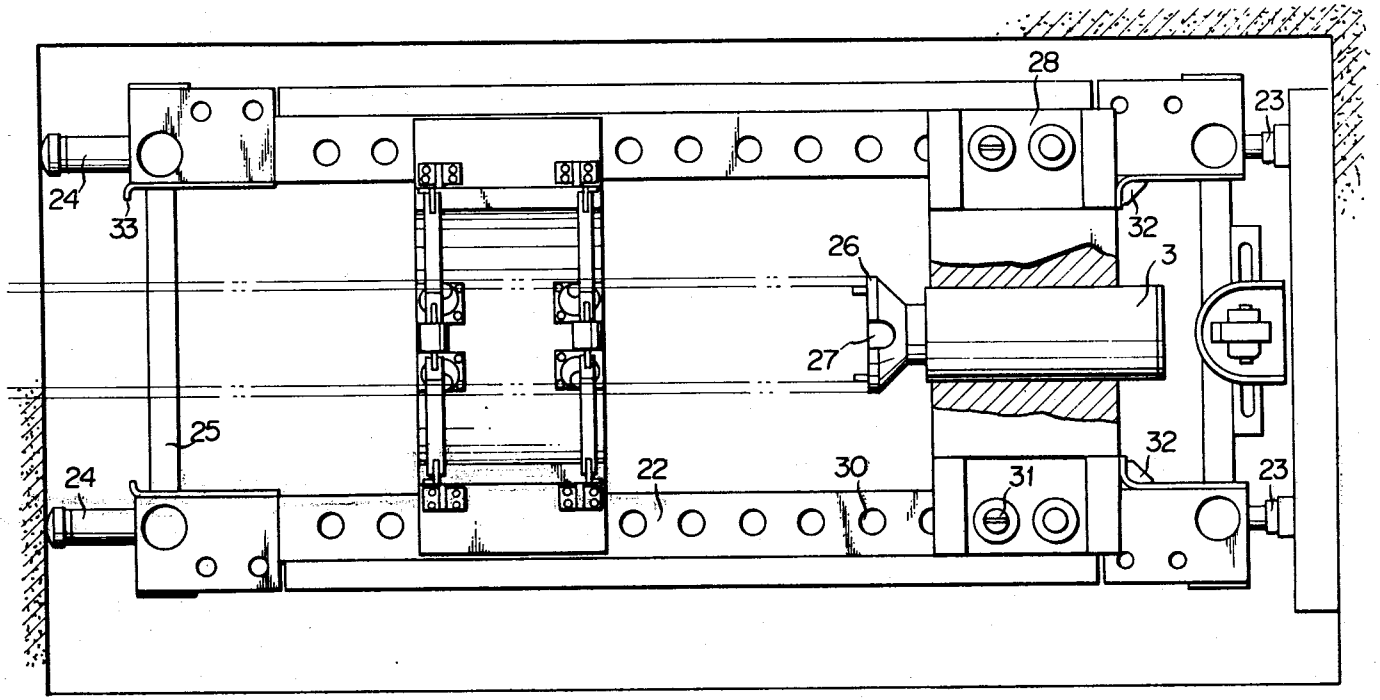
FIG. 2 is a plan view of a pipe propulsion device.
Figure 3:
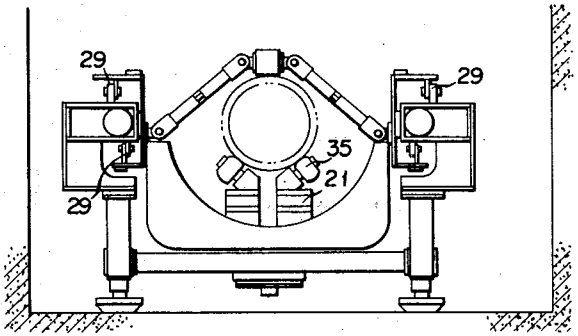
FIG. 3 is a left-hand side elevational view of FIG. 2.

As shown in FIGS. 2 and 3, the propulsion device 6 comprises a pair of rails 22, the rail legs 19, the propulsion jack 3, the pipe support 21, a pair of equalizing jacks 23 located rearwardly of the rails 22, and a pair of screw jacks 24 located forwardly of the rails 22. The rail legs 19 extend downwardly in a direction normal to a plane in which the two parallel rails 22 lie, the legs 19 being connected by a pair of channels 25 to form the rails 22 integrally with each other. The rails 22 installed in the departure pit 4 extend in parallel with the direction of advance of the propelled pipes. As described before, the height and grade of the rails 22 is established by changing the length of the four adjustable rail legs 19. A propulsion adapter 26 is attached to the front end of the propulsion jack 3, the adapter 26 having parts suitable in shape for fitting with the pilot pipes 2. The propulsion adapter 26 has a cutaway recess 27 through which there are passed the hydraulic rubber hose 11 and the electric cable 14 that lead from the pilot head 1. The front end of the adapter 26 has its outside diameter smaller than the inside diameter of the rear end of the pilot head and of the pilot pipes such that the adapter is prevented from slipping away from the pilot and the pilot pipes. The adapter 26 has a pair of bosses 36 (FIG. 4) which are bolted to a pair of bosses 37 (FIG. 4) of the pilot head or the pilot pipes. The propulsion jack 3 is palced on the two rails with propulsion jack brackets 28 interposed therebetween. The propulsion jack 3 mounted on the propulsion jack bracket 28 is movable on the rails forwardly and rearwardly in the direction of advance of the pipes by means of rollers 29 mounted on the brackets 28, but is not movable vertically and laterally. The propulsion jack 3 is secured to the rails 22 by inserting pins 31 into registered pin-receiving holes 30 which are formed in the rails 22 and the propulsion jack brackets 28. The distance of any adjacent holes 30 in the rails is made smaller than the full stroke of the propulsion jack. When the propulsion jack, secured at a given position to the rails, is extended the full stroke, then the pins 31 are removed and the propulsion jack is contracted by a full stroke. Thereafter, the propulsion jack 3 is shifted forwardly on the rails and the pins 31 are inserted again, when the propulsion jack is ready for the next propulsion. This operation is repeated so as to move the propulsion jack brackets 28 forwardly in an intermittent step-like manner. Upon the completion of propulsion of the entire length of the pipe 2 to be laid in, the propulsion jack is manually returned to rear stoppers 32, whereupon a next pipe may be set and likewise propelled. The rails are pressed against the reaction plate 7 through the equalizing jacks 23. The reaction force that the propulsion jack 3 creates during the pipe propulsion acts through the propulsion jack brackets 28, the pins 31, the rails 22 and the equalizing jacks 23 at the rear ends of the rails against the reaction plate 7. The propulsion jack 3 and the propulsion jack adapter 26 have axial bores through which the interior of the laid-in pipes can be viewed from the rear end of the propulsion device. Thus, as shown in FIG. 1, the target 20 in the pilot head 1 can be measured by the transit 8 set previously in a datum position and direction for the pipe laying-in at a position adjacent the reaction plate 7 in order to determine the position and tilt of the pilot head for the direction control of the latter.

The pipe support 21 is vertically movable by a hydraulic jack to raise or lower a pair of pipe-supporting rollers 35 so that pipes of different sizes can be laid. The the pipes to be laid, which may be of different sizes, are placed on the rollers 35 so that their axis can aligned with that of the propulsion jack. Since the pipe support 21 is shiftable on and along the rails with a pipe being supported thereon, the pipe support 21 may be moved to an any selected position whereupon a pipe to be laid in can be set thereon and can be propelled by the propulsion jack. With the pipe support 21 supporting the pipe via the rollers 35, after the pipe support 21 is moved to the stoppers 32 on the rails, the pipe can only be moved forward without the movement of the pipe support 21. Accordingly, the setting operation of the pipes can be made with ease and the pipes can be supported on the propulsion device 6 until the completion of laying of the pipes into the ground.

The rails 22 of the propulsion device are immovably supported by the screw jacks 24 held against the front wall of the departure pit and by the equalizing jacks 23 held against the rear wall of the departure pit through the reaction plate 7. A jack-extending side of the cylinder of the equalizing jacks 23 is arranged to be supplied with the same hydraulic pressure as the propulsion jack 3. Each of the two equalizing jacks 23 has the jack-extending cylinder side with an area against which the pressure acts being slightly larger than half of a pressure-acting area in a jack-extending cylinder side of the propulsion jack 3. Assuming that a propulsion force acting on the propulsion jack 3 is F, F acts through the rails on the two equalizing jacks 23, and with the arrangement described above, the equalizing jacks 23 are subject to a force of $F + \alpha$( the force $\alpha$ is small in comparison with F ). Thus, the propulsion rails 22 are pressed against the rear wall of the departure pit by the two equalizing jacks 23 developing the force $\alpha$, so that the propulsion devise 6 can be held stationary.

Normally, the rear wall of the departure pit is formed by placing sheet piles or concrete in order to withstand the reaction force from the propulsion jack 3. Practically, the propulsion rails are very difficult to be maintained stationary and thus tend to become displaced when the propulsion force is exerted. According to the invention, the displaced amount is absorbed by the extensible and contractable equalizing jacks 23 thereby maintaining the propulsion rails 22 in a fixed position.

The front ends of the propulsion rails are adapted to be pressed against the front surface of the departure pit through the screw jacks 24 attached to the front ends of the propulsion rails, the screw jacks 24 being arranged to withstand a retracting force which is created during the retraction and re-propulsion of the pilot head, as hereafter described.

The equalizing jacks 23 and the screw jacks 24 can be removed and attached with ease, and the jacks can be replaced with each other in position. More specifically, the pipe arrangement for the equalizing jacks 23 is removed and then the stoppers 32 which serve as covers for the propulsion rails are removed to take out the equalizing jacks 23. Likewise, covers 33 on the front end of the propulsion rails are detached to take out the screw jacks 24. The equalizing jacks 23 and the screw jacks 24 are replaced with each other in position and the covers are attached as before. When it is necessary to change the direction of propulsion of the propulsion jack 3, the latter is reversed in its longitudinal direction by detaching and attaching the propulsion jack brackets 28. More specifically, the propulsion jack 3 and the propulsion jack brackets 28 are separated from each other by removing bolts which connect these members together. After the propulsion jack 3 is removed, the pins 31 are detached and then the two opposed propulsion jack brackets 28 placed on the propulsion rails 22 are forced to slide along the inside of the rails and finally out of the rails. The pipe support 21 is moved on the propulsion rails 22 and the removed propulsion jack brackets 28 are reversed in the direction of propulsion, whereupon the brackets are secured to the rails 22 by the attachment pins 31. Then, the removed propulsion jack is reversed in its longitudinal direction and is inserted between the propulsion jack brackets 28. The propulsion jack 3 and the propulsion jack brackets 28 are securely bolted to each other. Locations at which the reaction plate 7 and the transit 8 are installed are changed, then the screw jacks 24 are attached and the equalizing jacks 23 are piped. In this way, the direction of propulsion can be reversed without moving the propulsion rails which have been installed in alignment with the direction of laying-in of the pipes. Thus, the direction of propulsion can be changed only by lifting the lightweight parts without employing a large-sized crane which would otherwise be required to lift the propulsion rails 22. With this arrangement, working efficiency can be greatly enhanced.

The steps of laying in the pilot pipes by propelling the pilot head will not be described. The pilot head 1 is first placed on the pipe support 21. Upon movement of an operation lever (not shown) connected to a hydraulically-operated valve in the control unit 9, a pilot jack 34 provided on the front portion of the pilot head is advanced and pressed into the ground by the distance of the full stroke of the jack. The operating lever is returned to its neutral position and another lever is operated, whereupon the rod of the propulsion jack 3 is advanced to press the pilot head into the ground. At this time, the pilot jack 34 is contracted by the pressing force of the pilot head 1. The reaction force during this operation acts against the reaction plate 7 through the pins 31, the rails 22, and the equalizing jacks 23 located at the rear ends of the rails.

When the rod of the propulsion jack 3 is extended to the end of its stroke, the pins 31 are pulled up whereupon the lever is moved in the reverse direction in order to withdraw the rod. Since the rod of the propulsion jack 3 is bolted to the pilot head 1 via the adapter 26, the propulsion jack proper is advanced upon the advance of the pilot head. Then the pins 31 are inserted into and engaged with the pin-receiving holes in the propulsion jack bracket 28 and the holes in the rails, which holes are located forwardly of those which have previously received the pins. As before, the pilot jack 34 is first advanced and the propulsion jack 3 is then advanced. The pilot head is pressed into the ground by what might be called "multi-step propulsion."

When the pilot head is laid completely in the ground, the pins 31 engaging the propulsion jack bracket 28 with the rails 22 are pulled up, and then the propulsion jack 3 is manually or power-drivingly returned into abutment against the rear stoppers 32. The pipe support 21 is manually returned to a position substantially centrally between the rear end of the pilot head and the propulsion jack adapter 26.

The pilot pipe 2 to be laid in, is placed on the pipe-supporting rollers 35, whereupon a collar 38 (FIG. 5) is attached to the front end of the pilot pipe 2. The connectors 13, 16 of the hydraulic rubber hose 11 and the electric cable 14, respectively, are detached from the control unit 9, and then are passed through the pilot pipe 2 from the front end of the latter for connection with the control unit 9. The pilot pipe 2 is shifted on the pipe-supporting rollers 35 to insert the collar 38 into the rear end of the pilot head 1. The bosses 37 on the rear end of the pilot head and the bosses 37 on the front end of the pilot pipe are connected together by bolts 40 and nuts 41 with rubber washers 39 interposed therebetween.

By inserting the rubber washers 39, the pilot head and the pilot pipe are prevented from being rigidly interconnected, and this head-to-pipe connection can be bent vertically and horizontally as the rubber washer 39 is compressed. This connection is hereafter referred to as a "loose-coupling."

Finally, the propulsion jack is manually moved until the adapter 26 coupled to the propulsion jack 3 abuts against the rear end of the pilot pipe 2, and then the pins 31 are inserted into the pin-receiving holes 30 so as to secure the propulsion jack to the rails.

In this way, the preparation for a next propulsion is completed. The pilot pipes 2 are then pressed into the ground through the multi-step propulsion using the propulsion jack 3 and the pilot jack 34.

When the front end of a first pilot pipe 2 has reached the arrival pit 5, the bolts and nuts connecting the bosses 37 together as well as the hydraulic rubber hose 11 and the electric cable connected to the rear end of the pilot head by connectors are removed. The pilot head is disconnected from the pilot pipe and is collected. Then, the hydraulic rubber hose 11 and the electric cable 14 are withdrawn at the departure pit, when the laying-in of the pilot pipes are completed.

A process of correcting the deflected direction of propulsion pf the pilot head will not be described, which deflected direction of propulsion may be caused by unbalanced soil or stones during the laying-in of the pipes.

Figure 4:
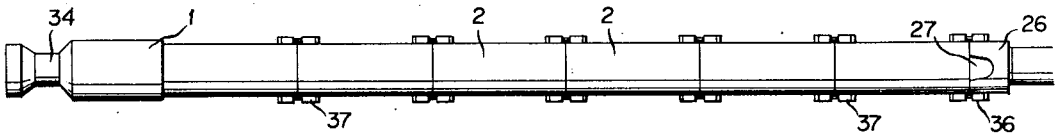
FIG. 4 is a schematic view explanatory of the way in which a pilot head and the pilot pipes are interconnected with each other.
Figures 1, 6:
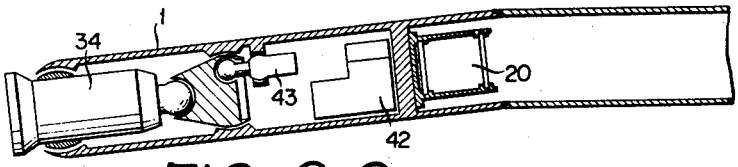
Figures 2, 6:
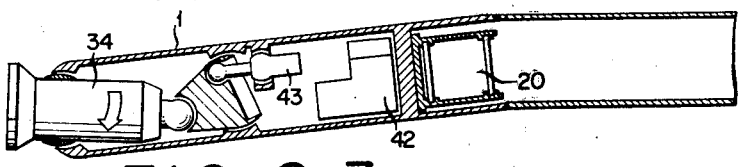
Figures 3, 6:
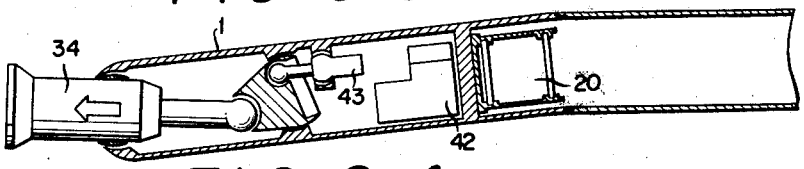
Figures 4, 6:
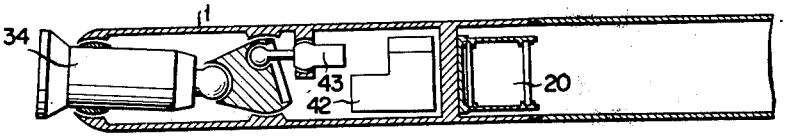

FIGS. 6-1 through 6-4 schematically shows successive steps in which the pilot head is operated to change its direction of advance.

FIG. 6-1 shows the pilot head deflected downwardly in its direction of propulsion under the influence of unbalanced soil, stones or the like. The deflection in the direction of propulsion can be read out by observing the target 20 in the pilot head through the transit 8 or by detecting an electric signal of a clinometer 42 at the control unit 9.

FIG. 6-2 shows the pilot jack 34 being swung by operating a cylinder 43.

FIG. 6-3 shows the pilot jack 34 being hydraulically advanced.

When the pilot jack 34 is advanced, the pressure acting on jack-extending side of the pilot jack cylinder is released. The pilot head and the pilot pipes are then advanced by the propulsion jack 3 in the departure pit 4, so that the pilot head proper is propelled forwardly as the pilot jack 34 is contracted on account of the soil abutting against the front surface of the pilot head. By repeating this operation, the pilot head proper is subject to a force tending to follow the pilot jack 34 and finally is returned to the correct position. In FIG. 6-4, the pilot head is maintained in its correct position. In this position, after the pilot jack 34 is horizontally advanced, the advance of the pilot head and the pilot pipes are repeated so that the pilot head can make its straight advance in a relatively stable manner. In accordance with this invention, the advance of the pilot head is less influenced by the unbalanced soil than where the pilot head is pressed into the ground by the propulsion jack without using the pilot jack.

There will now be discussed a process of correcting a high degree of deflection in the direction of propulsion of the pilot head, which deflection is unable to be recovered by the foregoing correction process.

Figure 5:
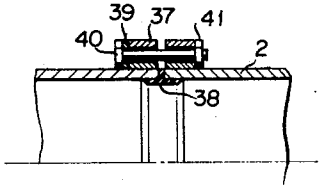
FIG. 5 is a fragmentary enlarged view showing the manner in which the pipes are interconnected.

The pilot head 1, the pilot pipes 2 and the propulsion jack 3 in the departure pit are interconnected by the bolts as shown in FIG. 4, so that the pilot head and the pilot pipes can be propelled or withdrawn by the propulsion jack 3 in the departure pit. The force created when the propulsion jack 3 in the departure pit withdraws the pilot head and the pilot pipes acts against the front wall of the departure wall though the propulsion rails 22. With this arrangement, when the pilot head is deflected from a desired direction of propulsion, the pilot head and the pilot pipes can be pulled back a certain distance, whereupon the direction of propulsion of pilot head can be corrected according to the foregoing process and then the pilot head and the pilot pipes can be propelled again. The pilot head 1 and the pilot pipes 2 are bolted, but one or more bolt-connections as shown in FIG. 4 are made by means of the loose-couplings as shown in FIG. 5 which are different than tight-couplings at the other bolt-connections, so that direction control of the pilot head can maintained and at the same time can be withdrawn. The pilot pipes 2 which are tightly coupled and follow the loosely coupled pipes are propelled in the ground as a straight, rod-like member. This is advantageous in that it corrects and reduces meandering movement of the pilot head during its direction control operation, and is useful especially where drainage conduits are laid in when meandering disposition of the conduits is prohibited strictly.

Figure 7:
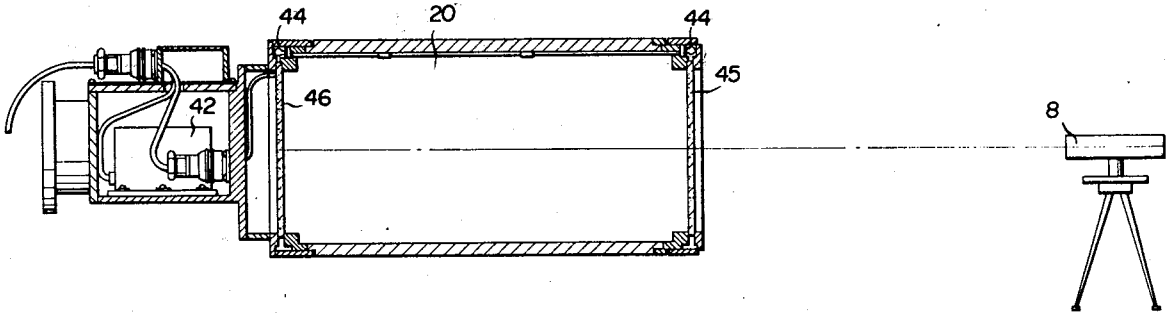
FIG. 7 is a schematic view showing the manner in which the position and posture of the pilot head are observed.

FIG. 7 is a schematic view showing in detail the target 20 and clinometer 42 for detecting the direction of the pilot head. The target 20 comprises a pair of indicia plates 45, 46 each made of a transparent plate such as a sheet of glass having indicia inscribed thereon, and a pair of lamps 44 for illuminating the indicia, the indicia plates being arranged perpendicualrly to the axis of propulsion of the pilot head and being built in the casing of the pilot head. The center of the two indicia plates 45, 46 is positioned on the axis of propulsion of the pilot head. When the lamp 44 for the indicia plate 45 is turned off and at the same time the lamp 44 for the indicia plate 46 is turned on, the transit 8 set in registry with the datum line of propulsion within the departure pit can readily observe the indicia plate 46 since the indicia plate 45 is transparent. When it is necessary to observe the indicia plate 45, the lamp 44 for the indicia plate 46 is turned off and the lamp 44 for the indicia plate 45 is turned on. The displacement of the indicia plates 45, 46 from the datum line of propulsion is observed by the transit 8, according to which a tilt of the pilot head can easily be determined by the calculation of the trigonometric function. With the arrangement shown in FIG. 7, the position and tilt of the pilot head can be measured by the transit and, furthermore, a tilt of the pilot head in the vertical direction is electrically detected by the clinometer 42, the detected signal therefrom being transmitted through the electric cable to an indicator (not shown) in the departure pit, at which indicator the signal can be read out. With the use of the clinometer 42, there are no reading errors by the observation of the transit 8 and high-precision measurement is possible. The clinometer 42 is suitable particularly for drainage construction where high pipe laying-in precision is required in the direction of plane normal to the axis of the laid-in pipes. As another example of the target, there may be used an arrangement of the type having a convex lens at the leftwardly of the indicia plate 45 of FIG. 7 and a light spot position detector (not shown) in lieu of the indicia plate 46. The signal from the light spot position detector is amplified by an amplifier and can be read out at the indicator in the departure pit. By using a transit with a laser as the transit, the position of the indicia plate and the signal from the light spot position detector generated by the emission of a leaser beam can simultaneously be read out. This arrangement makes it possible to measure a tilt angle of the pilot head with high precision where the pilot head is propelled in the ground a long distance.

Figure 8:
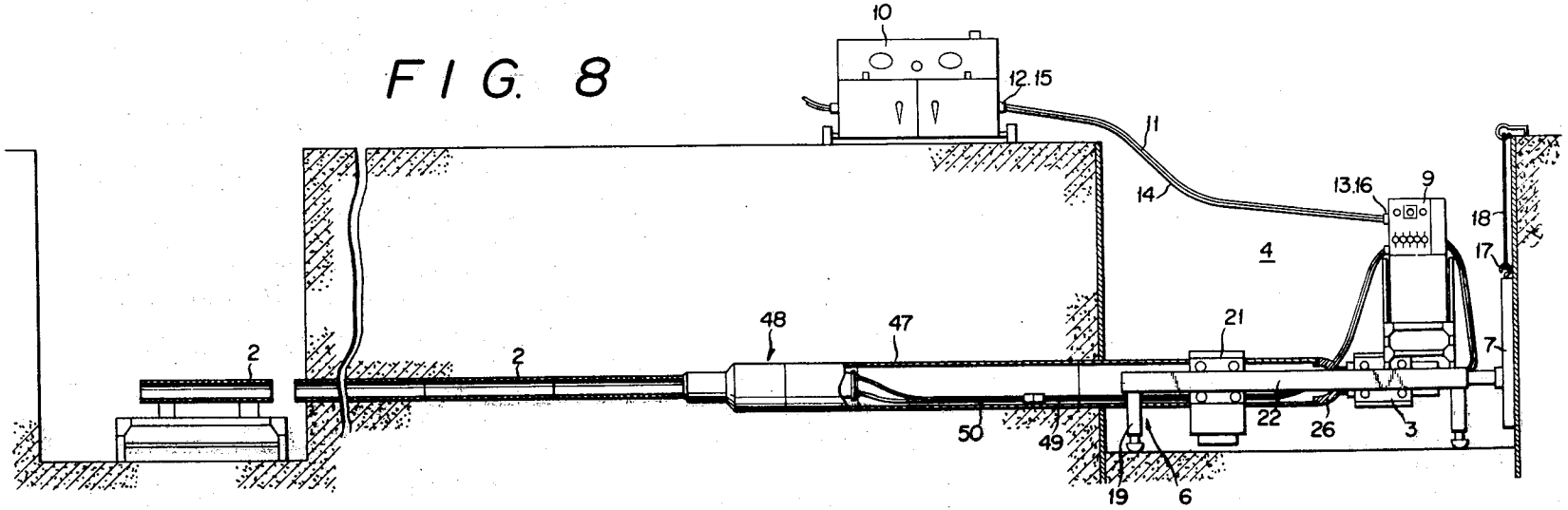
FIG. 8 is a schematic elevational view explanatory of the way in which large-diameter pipes are led by pilot pipes and laid in according to the invention.

Next, a process in which the pilot pipes are laid in, and then pipes 47 which are larger indiameter then the pilot pipes are led by the pilot pipes and laid in will be described with reference to FIG. 8. FIG. 8 shows a position where the pipes 47 are laid partially in the ground.

The pipe-supporting rollers 35 of the pipe support 24 are adjusted in height to align the pipe 47 to be laid in coaxially with the propulsion jack 3. The adapter 26 is replaced with a new one which has parts fitted with the diameter of the large-diameter pipe 47 rather than the pilot pipes, and then the transit 8 is removed from within the departure pit. A multistage head 48 is placed on the pipe support 21 with a front end portion of the multistage being connected with a rear end portion of the pilot pipe. The hydraulic rubber hoses 49 and 50 extending from the control unit 9 are connected to oil passageways for the multistage head, respectively, via connectors.

Figures 1, 9:
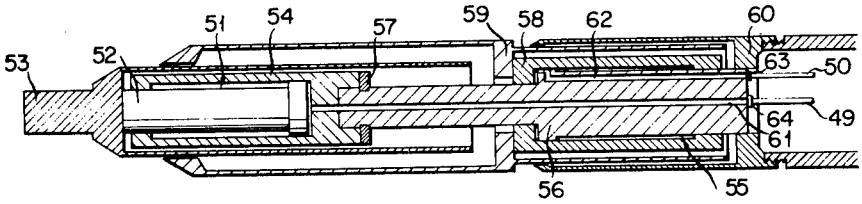
Figures 2, 9:
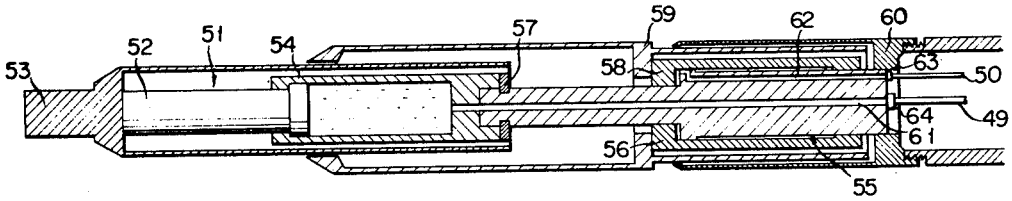
Figures 3, 9:
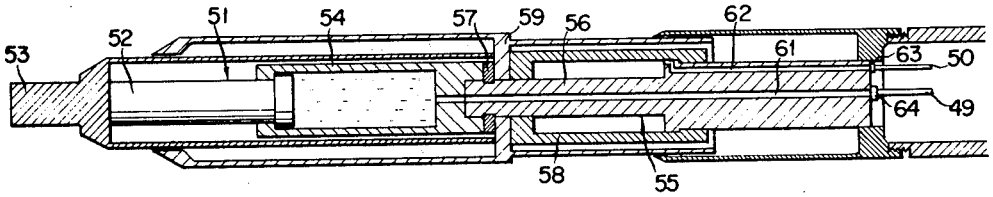

The preparation of laying-in of the large-diameter pipes 47 is now completed and the operation of laying-in of the pipes will be started by the use of the propulsion jack 3 and the multistage head 48. FIGS. 9-1 through 9-3 are longitudinal cross-sectional views of the multistage head 48 employed in this invention, the views showing successive steps of operation of the multistage head. A first stage ram 51 has a rod 52 having a front end secured to a first head 53. A first stage cylinder 54 has a rear portion connected with a rod 56 of a second stage ram 55 via a flange 57. The second stage ram 55 has a cylinder 58 fixed to a second head 59. The second stage ram 55 is of the double rod cylinder type, and the rod 56 is arranged to extend beyond the longitudinal ends of the cylinder 58. The rod 56 had a rear portion connected to a third head 60. All of the heads are longitudinally slidable with respect to each other. The rod 56 of the second stage ram 55 is of a hollow structure to provide an oil passageway 61 for the first stage ram 51. Alternatively, a hydraulic hose may be passed through the hollow rod 56. The rod 56 of the second stage ram 55 is provided therein a passageway 62. Oil passing through the hydraulic hoses 49 and 50 flows through the passageways 61, 62 into the first cylinder 54 and the second cylinder 58, respectively. Designated at reference numerals 63, 64 are connectors which interconnect the hydraulic rubber hoses 49, 50 with the passageways 61, 62, respectively.

The process of propulsion of the multistage head 48 will now be described. In FIG. 9-1, oil under pressure is supplied from the hydraulic rubber hose 49, through the passageway 61 into the cylinder 54 of the first ram 54. The rod 52 is then extended by oil under pressure with the head 53 acting for consolidation of soil, when the position of the parts is shown in FIG. 9-2.

Then, oil under pressure is introduced from the hydraulic rubber hose 50 through the passageway 62 into the cylinder 58 of the second head 59, whereupon the second head 59 is pushed and extended for consolidation of soil, the parts being moved to the position shown in FIG. 9-3. At this time, the oil pressure within the first ram 51 is prevented from being relieved, so that the first stage head remains extended. Then, hydraulic circuits for the first stage ram 51 and the second stage ram 55 are open, whereupon the propulsion jack 3 disposed within the departure pit is driven to press and propel the rear end of the multistage head 48. The third head 60 advances with the first and second heads 53, 59 being stopped in position by soil, as the first stage ram 51 and the second stage ram 55 are contracted, the parts being returned to the position of FIG. 9-1. By repeating the foregoing steps, the multistage head 48 is propelled. When the multistage head 48 is thus laid into the ground a predetermined distance, the propulsion jack 3 is returned. Then, a first pipe 47 to be laid in is placed on the pipe support 21 and laid in by driving and controlling the multistage head 48 and the propulsion jack in a manner described. This operation is repeated with respect to a first, second . . . *n*th pipe and the overall laying-in operation becomes completed when the multistage head 48 is all pushed out into the arrival pit.

As mentioned above in detail, in accordance with the invention, the pilot pipes can be laid in position in the ground on account of the pilot head being observed and controlled relative to its position and posture. Advantageously, during the laying-in operation of the pipes which are larger in diameter than and are led by the laid-in pilot pipes, the employed multistage head meets with a relatively small resistance upon consolidation of soil and thus requires only a relatively small propulsion force.

What is claimed is:

1. A method of laying pipes in the ground comprising:

a. digging a departure pit and an arrival pit spaced apart from the departure pit;

b. providing a propulsion jack in said departure pit, the propulsion jack being adapted to press and propel pipes to be laid in;

c. pressing a pilot head into the ground in said departure pit in a direction towards said arrival pit by means of a pilot jack coupled thereto and then pressing said pilot head further into said ground, wherein the pilot jack is placed into a contracted state by the pressing force of said propulsion jack;

d. pressing pilot pipes successively into the ground by said propulsion jack, said pilot pipes being in a following relationship with said pilot head;

e. measuring the position and posture of said pilot head at the departure pit during the pressing and laying-in of the pilot head;

f. controlling the straight advance of the pilot head based on said measurement;

g. bringing a multistage head into abutment against the rearmost end of the laid-in pilot pipes after the latter are laid in;

h. pressing the rear end of said multistage head and laying in the multistage head by said propulsion jack;

i. connecting pipes to be laid in to the rear end of said multistage head, said pipes being larger in diameter than said laid-in pilot pipes;

j. propelling said pipes in succession into the ground by said propulsion jack; and k. collecting said laid-in pilot pipes in the arrival pit.

2. A method according to claim 1, further comprising collecting said multistage head in the arrival pit.

3. A method according to claim 1, further comprising withdrawing said pilot head and said laid-in pilot pipes toward the departure pit, and laying in the pipes again with the straight advance of the pilot head being measured and controlled at the departure pit.

4. A method according to claim 1, further comprising propelling first a foremost head of said multistage head by hydraulic means provided independent of the propulsion jack, and propelling finally a rearmost head of said multistage head by said propulsion jack.

* * * * *